US008540174B2

(12) United States Patent
Makino

(10) Patent No.: US 8,540,174 B2
(45) Date of Patent: Sep. 24, 2013

(54) METHOD FOR PRODUCING POWDER AND FLUIDIZED BED PULVERIZING APPARATUS

(75) Inventor: Nobuyasu Makino, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 372 days.

(21) Appl. No.: 12/888,964

(22) Filed: Sep. 23, 2010

(65) Prior Publication Data

US 2011/0073687 A1 Mar. 31, 2011

(30) Foreign Application Priority Data

Sep. 25, 2009 (JP) ..... 2009-221203

(51) Int. Cl.
*B02C 19/06* (2006.01)

(52) U.S. Cl.
USPC ..... 241/5; 241/39; 241/19

(58) Field of Classification Search
USPC ..... 241/5, 39, 19, 79.1
See application file for complete search history.

(56) References Cited

U.S. PATENT DOCUMENTS

| | | | |
|---|---|---|---|
| 7,032,849 | B2 | 4/2006 | Takahashi et al. |
| 7,661,611 | B2 | 2/2010 | Kubota et al. |
| 7,753,296 | B2 | 7/2010 | Makino et al. |
| 2003/0178514 | A1 | 9/2003 | Makino et al. |
| 2010/0170966 | A1 | 7/2010 | Makino |

FOREIGN PATENT DOCUMENTS

| | | |
|---|---|---|
| JP | 5-146704 | 6/1993 |
| JP | 7-4557 | 1/1995 |
| JP | 2503826 | 4/1996 |
| JP | 8-117690 | 5/1996 |
| JP | 11-295929 | 10/1999 |
| JP | 2002-126560 | 5/2002 |
| JP | 2006-297305 | 11/2006 |
| JP | 3995335 | 8/2007 |
| JP | 4025179 | 10/2007 |
| JP | 4291685 | 4/2009 |

OTHER PUBLICATIONS

"Latest Ultrafine Pulverization Process Technology", Fluidized Bed Counter-Jet Mill Type AFG, Mar. 31, 1985, 3 pages. (with Partial English Translation).

Office Action issued Jan. 30, 2012, in Korean Patent Application No. 10-2010-0092939 (with English-language translation).

*Primary Examiner* — Mark Rosenbaum

(74) *Attorney, Agent, or Firm* — Oblon, Spivak, McClelland, Maier & Neustadt, L.L.P.

(57) ABSTRACT

A method for producing powder including supplying a powder material to a fluidized bed container, jetting fluid from each of a plurality of fluid jetting nozzles provided in the fluidized bed container to collide against each other, thereby fluidizing and pulverizing the powder material in the fluidized bed container to form powder, classifying the powder using a centrifugal classification rotor provided at the upper part of the fluidized bed container and discharging the classified powder from an outlet by being guided by the centrifugal classification rotor, wherein the centrifugal classification rotor is rotated at a first rotating speed for a predetermined time from the beginning of the flow of the powder material in the fluidized bed container, and at a second rotating speed after the predetermined time has passed, and the centrifugal classification rotor is controlled so that the first rotating speed is higher than the second rotating speed.

10 Claims, 1 Drawing Sheet

METHOD FOR PRODUCING POWDER AND FLUIDIZED BED PULVERIZING APPARATUS

BACKGROUND OF THE INVENTION

1. Field of the Invention

The present invention relates to a method for producing powder and a fluidized bed pulverizing apparatus.

2. Description of the Related Art

A toner used for an electrophotographic image forming apparatus is formed of fine particles having relatively uniform particle sizes of micron order. As an apparatus for producing such fine particles (powder) of micron order, a fluidized bed pulverizing apparatus (also called as an air flow pulverizing apparatus) is known. The fluidized bed pulverizing apparatus is constituted with a pulverization chamber (fluidized bed container), in which pulverization of a powder material is performed by allowing the powder material to collide against each other, a plurality of fluid jetting nozzles for jetting fluid in the pulverization chamber so as to entrain the powder material in the fluid, followed by colliding against each other so that the powder material entrained therein also collide each other, and then forming a fluidized bed in which the powder material further collide and are pulverized, and a centrifugal classification rotor which classifies the finely-pulverized powder, and is provided at the upper part of the pulverization chamber. In a typical fluidized bed pulverizing apparatus, the powder material supplied into the pulverization chamber are entrained in air flows which are jetted from a plurality of pulverizing nozzles, respectively, so as to collide against each other, and the powder material along with the air flow collide against each other, and then are pulverized. The air flow entirely fluidizes the powder material in the pulverization chamber, so as to accelerate pulverization caused by collision between the powder materials. Part of the powder material which has been pulverized and fluidized is guided to the area near a rotating rotor provided at the upper part of the pulverization chamber, and the particles of powder material each having a certain particle size or smaller are guided inside the rotor along with the fluid flow, and then powder as a final product (hereinafter referred to as product powder) is taken out from an outlet. The particles of the powder each having a certain particle size or larger are returned back to the outer periphery of the rotor by the centrifugal separation effect of the rotating roller, and are again returned back to the pulverization chamber, and then subjected to pulverization therein.

FIG. 1 shows a cross-sectional view of a conventional fluidized bed pulverizing apparatus. With reference to FIG. 1, a structure of the conventional fluidized bed pulverizing apparatus and a method for producing powder will be described below. In FIG. 1, 1 denotes a powder material supply inlet, from which a powder material is supplied, 2 denotes an outlet which discharges pulverized powder as a product along with exhaust air, 3 denotes a centrifugal classification rotor which classifies the pulverized powder, 4 denotes a pulverization chamber in a fluidized bed container, 5 denotes fluid jetting nozzles whose jetting openings are arranged inside the pulverization chamber 4, and which face each other and jet fluid, 6 denotes a motor driving the centrifugal classification rotor 3. The external appearance of the main body of the entire fluidized bed pulverizing apparatus is a substantially cylindrical housing.

The operation of the fluidized bed pulverizing apparatus shown in FIG. 1 is as follows. At first, before operation of the apparatus, inside the pulverization chamber 4 a certain amount of the powder material is charged. Next, compressed air is jetted from each of the two fluid jetting nozzles 5 facing each other, the air jetted from each of the two fluid jetting nozzles 5 forms jetted air flow. The jetted air flow entrains the powder material which is present in the pulverization chamber 4, so as to transport the powder material. The two jetted air flows entraining the powder material collide against each other near the center of the pulverization chamber 4, so as to form air flow upward, downward, leftward and rightward directions inside the pulverization chamber 4. These air flows further entrain the powder material in the pulverization chamber 4, so as to form a fluidized bed of the powder material in the pulverization chamber 4. On the other hand, the powder material entrained in the jetted air flows collide against each other along with the collision of a plurality of jetted air flows, and are pulverized. Further, in the fluidized bed, the collision and pulverization of the powder material are repeated.

Air in the pulverization chamber 4 passes from the outer periphery of the centrifugal classification rotor 3 located at the upper part of the pulverization chamber 4, through a gap between the rotors provided in the centrifugal classification rotor 3, and is guided to the outlet 2 connected to the centrifugal classification rotor 3, and then discharged from the outlet 2 to the outside. The powder material forming the fluidized bed is raised along with the exhaust air to the upper part inside the pulverization chamber 4, and enter the gap between the rotors from near the outer periphery of the centrifugal classification rotor 3. The centrifugal classification rotor 3 rotates at a certain rotating speed, among the powder material along with the air flow which reach the gap between the rotors, the powder material each having a certain particle size or larger is blown away to the outside of the centrifugal classification rotor 3 by centrifugal force. The particles of powder material each having a particle size smaller than a certain particle size along with the air flow are guided from the centrifugal classification rotor 3 to the outlet 2, and then discharged to the outside. The particles of powder material each having a certain particle size or larger are blown away to the outside of the centrifugal classification rotor 3, fall down in the pulverization chamber 4, and then are pulverized again in the fluidized bed.

From the powder material supply inlet 1, the powder material in an amount corresponding to the amount of powder discharged from the outlet 2 are supplied to the pulverization chamber 4, and the amount of the powder material in the pulverization chamber 4 is kept constant. Thus, in the fluidized bed pulverizing apparatus, the particles of powder material each having a desired particle size can be continuously produced. Meanwhile, the particle sizes of the particles of the powder material discharged from the outlet 2 can be controlled by adjusting the rotating speed of the centrifugal classification rotor 3. The pulverizing speed of the powder material, namely production speed of the pulverized powder material can be controlled by adjustment of the speed and flow rate of the air flow jetted from the fluid jetting nozzle 5.

In the fluidized bed pulverizing apparatus, the powder material is repeatedly pulverized in the pulverization chamber, in order to obtain the particles of product powder each having a desired particle size. In this case, when the production speed of the product powder is intended to increase, it is necessary to increase air flow rate jetted from the fluid jetting nozzle 5 so as to increase the pulverization efficiency of the powder material. However, in the case where the air flow rate jetted from the fluid jetting nozzle 5 is increased, the amount of exhaust air is increased, decreasing the classification efficiency of the centrifugal classification rotor 3. As a result, the average particle size of the product powder may become large, or the particles of powder material each having a large particle size may be easily mixed in the product powder. The average particle size of the particles of product powder can be controlled by adjustment of the rotating speed of the centrifugal classification rotor 3 to some degree. However, it is not easy to prevent the large size particles of the powder material from being mixed in the product powder. Therefore, as a countermeasure for the problem of the mixture of the large size particles of the powder material in the product powder, there has been known a method of providing a baffle plate at the upper part of the pulverization chamber 4, by which the course particles are prevented from mixing in the product powder. However, this method may decrease pulverization efficiency, probably causing decrease in production speed.

Moreover, there has been proposed a fluidized bed pulverizing apparatus (also referred to as "an air flow pulverizing apparatus"), for the purpose of improvement of pulverization efficiency of the fluidized bed pulverizing apparatus, adjustment of particle size of the product powder, and stabilization of product quality.

For example, Japanese Patent Application Publication (JP-B) No. 07-4557 discloses an air flow pulverization method, in which the pulverization efficiency of the powder material is improved by using a pulverization medium having a relatively large particle size.

Japanese Patent Application Laid-Open (JP-A) No. 2002-126560 discloses an air flow pulverizer, in which the pulverization efficiency is improved by adjusting the internal pressure of a pulverization chamber to negative pressure, or rising temperature in the pulverization chamber.

Japanese Patent (JP-B) No. 4025179 discloses an air flow pulverizer, in which a secondary collision unit for powder material which has collided by jetted air flow is provided so as to increase probability of collision between the powder materials, thereby increasing the pulverization efficiency.

JP-B No. 4291685 discloses an air flow pulverizer, in which compressed air jetted from a jetting nozzle is heated so as to improve the pulverization efficiency of the powder material, and the particle size of the product powder is optimized.

JP-A No. 2006-297305 discloses an air flow pulverizer, in which a space blocking member is provided in the inner wall of the pulverization chamber, particularly around a jetting nozzle, so as to decrease a dead space in the fluidized bed during the formation of the fluidized bed, thereby increasing the pulverization efficiency.

JP-B No. 2503826 discloses an air flow pulverizing method, in which a bypass directly leading from the pulverization chamber to the channel for discharging the final powder is provided so as to control the particle size distribution of the product powder.

JP-A No. 05-146704 discloses an air flow pulverizing method, in which a load current value of a motor for driving a classification rotor of a classifier is calculated as an integrated value of a predetermined time, and based on the value the supply amount of the powder material is adjusted so as to stabilize the particle size of the product powder.

JP-A No. 3995335 discloses an air flow pulverizer which controls the quality of the product powder in such a manner that the density of fluidized powder material in the pulverization chamber of the air flow pulverizer and the amount of powder material deposited in the lower part of the pulverization chamber are measured, and according to the density and the amount, the taking out of the deposited powder material and the supply of the raw material of the powder are controlled.

By using the above-described fluidized bed pulverizing apparatuses (air flow pulverizing apparatuses) or the fluidized bed pulverization methods, a certain effect is obtained for the purpose of improvement of pulverization efficiency, adjustment of product quality, product quality stabilization. However, any of the fluidized bed pulverizing apparatuses (air flow pulverizing apparatuses) and the fluidized bed pulverization methods aims to improve pulverization efficiency, and adjust and stabilize of product quality only during steady operation. Therefore, they still have problems in terms of the adjustment of product quality and the stabilization of quality during the initial operation of the fluidized bed pulverizing apparatus.

At the beginning of the operation of the fluidized bed pulverizing apparatus, a powder material is entirely in non-pulverized state. When air is jetted from a jetting nozzle, the powder material present in the pulverization chamber is whirled up in the air jetted from the jetting nozzle, and the powder material is started to collide and form a fluidized bed. In the unsteady state during the initial formation of the fluidized bed, not only the abundance ratio of the pulverized particles of powder material each having a certain particle size or smaller is low, but also the ratio of the non-pulverized particles of the powder material each having a large particle size introduced into a centrifugal classification rotor provided at the upper part of the pulverization chamber is high. In such unsteady operation state, the particle size of the product powder discharged from the outlet along with the exhaust air from the centrifugal classification rotor tends to be large. Thus, during the initial operation of the apparatus, the quality of product powder is not stable. In the case where the quality of the product powder is emphasized, the discharged product powder is discarded or recycled as an off-specification product for a certain time during the initial operation of the fluidized bed pulverizing apparatus, until the quality of the product powder finally becomes stable. In the fluidized bed pulverizing apparatus which is expected to produce a large number of product lots, every time when operation restarts for changing a product lot, off-specification products are formed, causing significant decrease in the production efficiency.

BRIEF SUMMARY OF THE INVENTION

An object of the present invention is to provide a method for producing powder and a fluidized bed pulverizing apparatus, which can stabilize quality of pulverized product powder during the initial operation of the apparatus, and improve the production efficiency.

Means for solving the above problems is as follows.

<1> A method for producing powder including: supplying a powder material from a powder material supply inlet to a fluidized bed container; jetting fluid from each of a plurality of fluid jetting nozzles provided in the fluidized bed container so as to collide against each other, thereby fluidizing and pulverizing the powder material in the fluidized bed container to form powder; classifying the powder using a centrifugal classification rotor provided at the upper part of the fluidized bed container; and discharging the classified powder from an outlet by being guided by the centrifugal classification rotor; wherein the centrifugal classification rotor is rotated at a first rotating speed for a predetermined time from the beginning of the flow of the powder material in the fluidized bed container, and at a second rotating speed after the predetermined time has passed, and the centrifugal classification rotor is controlled so that the first rotating speed is higher than the second rotating speed.

<2> The method for producing powder according to <1>, wherein the jetting further includes controlling the internal pressure of the fluidized bed container to negative pressure.

<3> The method for producing powder according to <1>, wherein the jetting further includes controlling the temperature inside the fluidized bed container.

<4> The method for producing powder according to <1>, wherein the jetting further includes controlling the injection pressure of the fluid jetted from the fluid jetting nozzle.

<5> The method for producing powder according to <1>, wherein the predetermined time from the beginning of the flow of the powder material for rotating the centrifugal classification rotor at the first rotating speed is controlled.

<6> The method for producing powder according to <5>, wherein the predetermined time is 10 seconds to 170 seconds.

<7> The method for producing powder according to <1>, wherein the supplying, the jetting, the classifying, and the discharging are performed by automatic control.

<8> The method for producing powder according to <1>, wherein the powder is a toner.

<9> The method for producing powder according to <1>, wherein the fluid is one selected from the group consisting of air, nitrogen, carbon dioxide, helium and argon or a mixture of two or more of these gases.

<10> A fluidized bed pulverizing apparatus including: a fluidized bed container in which a powder material is fluidized; a powder material supply inlet provided to the fluidized bed container, and configured to continuously introduce the powder material into the fluidized bed container; a plurality of fluid jetting nozzles provided to the fluidized bed container, and each configured to jet fluid so as to collide against each other; a centrifugal classification rotor provided at the upper part of the fluidized bed container and configured to classify powder; an outlet continuously discharging the powder classified by the centrifugal classification rotor; and a rotation control part configured to control the centrifugal classification rotor so that a first rotating speed for a predetermined time from the beginning of the flow of the powder material in the fluidized bed container is higher than a second rotating speed after the predetermined time has passed.

<11> The fluidized bed pulverizing apparatus according to <10>, further including a pressure control device configured to control the internal pressure of the fluidized bed container to negative pressure.

<12> The fluidized bed pulverizing apparatus according to <10>, further including a temperature control device configured to control the temperature inside the fluidized bed container.

<13> The fluidized bed pulverizing apparatus according to <10>, further including the injection pressure control part configured to control the injection pressure of the fluid jetted from the fluid jetting nozzle.

The fluidized bed pulverizing apparatus of the present invention includes a fluidized bed container in which pulverization of a powder material is performed by allowing the powder material to collide against each other, similar to the conventional fluidized bed pulverizing apparatus. The fluidized bed container has a powder material supply inlet which supplies the powder material to the fluidized bed container, and a plurality of fluid jetting nozzles arranged so that fluid jetted in the fluidized bed container collide against each other. Usually, the fluidized bed container (also referred to as "pulverization chamber") constitutes a main part of the main body of the fluidized bed pulverizing apparatus, and preferably has a substantially vertical cylindrical shape.

The present invention can provide a method for producing powder and a fluidized bed pulverizing apparatus, which can stabilize quality of pulverized product powder during the initial operation of the apparatus, and improve the production efficiency.

DETAILED DESCRIPTION OF THE INVENTION

Figure 1:
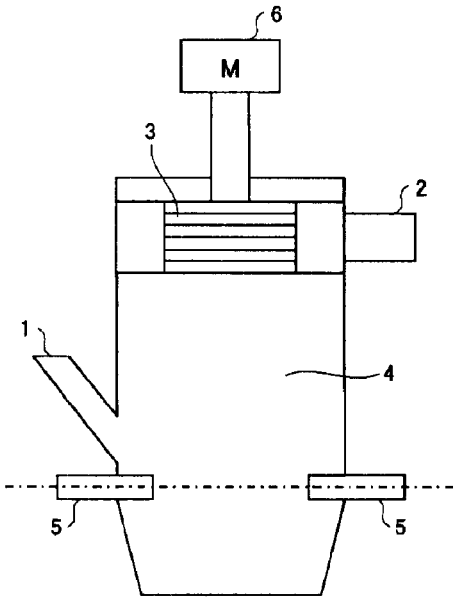
FIG. 1 is a schematic cross sectional view of an example of a conventional fluidized bed pulverizing apparatus.

A method for producing powder of the present invention includes: supplying a powder material from a powder material supply inlet to a fluidized bed container; jetting fluid from each of a plurality of fluid jetting nozzles provided in the fluidized bed container so as to collide against each other, thereby fluidizing and pulverizing the powder material in the fluidized bed container to form powder; classifying the powder using a centrifugal classification rotor provided at the upper part of the fluidized bed container; and discharging the classified powder from an outlet by being guided by the centrifugal classification rotor; and further includes other steps as necessary.

In the method for producing powder of the present invention, the centrifugal classification rotor is rotated at a first rotating speed for a predetermined time from the beginning of the flow of the powder material in the fluidized bed container, and at a second rotating speed after the predetermined time has passed, and the centrifugal classification rotor is controlled so that the first rotating speed is higher than the second rotating speed.

A fluidized bed pulverizing apparatus includes a fluidized bed container in which a powder material is fluidized; a powder supply inlet provided to the fluidized bed container, and configured to continuously introduce the powder material into the fluidized bed container; a plurality of fluid jetting nozzles provided to the fluidized bed container, and each configured to jet fluid so as to collide against each other; a centrifugal classification rotor provided at the upper part of the fluidized bed container and configured to classify powder; an outlet continuously discharging the powder classified by the centrifugal classification rotor; and a rotation control part configured to control the centrifugal classification rotor so that a first rotating speed for a predetermined time from the beginning of the flow of the powder material in the fluidized bed container is higher than a second rotating speed after the predetermined time has passed, and further includes other members as necessary.

Hereinafter, a method for producing powder of the present invention, and a fluidized bed pulverizing apparatus will be specifically described.

A fluidized bed pulverizing apparatus and a method for producing powder will be specifically described with reference to a cross sectional view of a fluidized bed pulverizing apparatus shown in FIG. 2

A fluid jetting nozzle 5 is arranged in a relatively lower part of a substantially cylindrical fluidized bed container (pulverization chamber 4) so as to jet fluid from the lateral part toward substantially central axis of the cylindrical fluidized bed container 4. The number of fluid jetting nozzle 5 is at least two, may be three or more, each of the jetting nozzles 5 is provided so that fluid to be jetted collide against each other. The fluid jetted from each of the jetting nozzles 5 entrains a powder material charged in the fluidized bed container 4, and the powder material collide against each other by collision of the jet flows. Preferably, the powder material in the fluidized bed container 4 is charged beforehand in such amount that the height of the charged powder material within the fluidized bed container 4 comes up to near or by the height of the position where the jetting nozzles 5 are provided. The jet flow changes its direction by collision so as to make flow upward and downward directions in the fluidized bed container 4. The powder material in the fluidized bed container 4 is further entrained in the fluid flows so as to start fluidization of the powder material, thereby forming a fluidized bed. In this case, it is preferred to consider the internal shape of the fluidized bed container, the positions of the jetting nozzles 5, and the direction for jetting the fluid so as not to form a dead space where no powder material is fluidized and accumulated.

Figure 2:
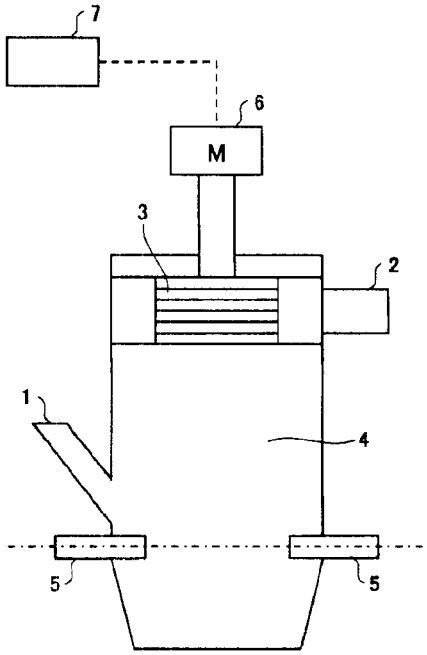
FIG. 2 is a schematic cross sectional view of an example of a fluidized bed pulverizing apparatus of the present invention.

The powder material supply inlet 1 may be provided in the lateral part of the fluidized bed container 4, and it is preferred that the powder material be provided in a position where the powder material is easily entrained in the fluid jetted from the jetting nozzles 5, for example, as shown in FIG. 2, just above the openings of the jetting nozzles 5. When the powder material is entrained in the fluid jetted from the jetting nozzles 5, the particles of the powder material easily collide against each other according to the collision between the jetted fluid, thereby improving the pulverization efficiency of the powder material.

A centrifugal classification rotor 3 is provided at the upper part of the fluidized bed container 4. The centrifugal classification rotor 3 is connected directly or via a belt to the motor 6 for driving the rotor, and driven to rotate by the motor 6. In the centrifugal classification rotor 3, generally a plurality of rotors are arranged in parallel with narrow intervals. The fluid inside the fluidized bed container 4 passes from the outer periphery of each rotor, through a gap between the rotors, and is discharged from the outlet 2 through an exhaust pipe provided in the centrifugal classification rotor 3.

Among the powder material fluidized along with the fluid in the fluidized bed container 4, a finely-pulverized powder material (also referred to as "powder") is entrained in the fluid flow and reaches the upper part of the fluidized bed container 4. Then the finely-pulverized powder along with the fluid passes from the outer periphery of each rotor of the centrifugal classification rotor 3, through a gap between the rotors, and is discharged from the outlet 2 through an exhaust pipe provided in the centrifugal classification rotor 3. In this case, when each of the rotors is rotated, part of the powder flown from the outer periphery of the rotor to the center thereof along with the fluid is returned back to the outer periphery of the rotor by the centrifugal force of the rotor, and further blown away to the lateral part of the fluidized bed container 4, and falls down in the fluidized bed container 4. Another part of the powder flowing along with the fluid is not returned back to the outer periphery of the rotor by the centrifugal force of the rotor, but entrained in the fluid flow, passes through the exhaust pipe, and then is discharged from the outlet 2.

Mainly depending on the size of each particle of the powder, rotating speed of the rotor, and flow strength of the fluid (flow velocity), it is decided whether the particles of powder are returned back to the outer periphery of the rotor by the centrifugal force of the rotor, or entrained in the fluid flow, followed by moving toward the center of the rotor, and then being discharged from the outlet 2. As the particles of the powder are large, the particles of the powder are returned back to the outer periphery of the rotor by the centrifugal force of the rotor. The faster the rotating speed of the rotor is, the stronger the centrifugal force is. Consequently, particles of the powder each having relatively a small particle size are returned back to the outer periphery of the rotor. When the flow strength of the fluid is large, i.e., the flow rate is high, the force of the flow entraining and transporting the powder material toward the center of the rotor becomes strong, and relatively large particles are discharged from the outlet 2 along with the fluid. The centrifugal classification rotor 3 classifies the powder floating in the fluid by taking advantages of these functions, and only particles of the powder each having a desired particle size or less are taken out as product powder from the fluidized bed container 4.

The particles of powder each having large size (coarse particles), which are returned back to the outer periphery of the rotor by the centrifugal force of the rotor, and fall down from the lateral part of the fluidized bed container 4, are again entrained in the flows jetted from the fluid jetting nozzles 5 in the lower part of the fluidized bed container 4, and pulverized to form finely-pulverized particles of powder. By repeating such pulverization and classification, finally, all particles of powder material are finely-pulverized and discharged as product fine particles (powder) each having a certain particle size from the outlet 2.

From the powder material supply inlet 1, a powder material (a raw material for powder) in an amount corresponding to the amount of the powder discharged from the fluidized bed container 4 as product powder is supplied, so that the fluidized bed pulverizing apparatus can be continuously operated. Then, product powder having stable quality (particle size) can be discharged from the outlet 2.

The fluidized bed pulverizing apparatus of the present invention includes a control device 7, which controls the operation of the entire apparatus. The control device 7 includes an entire control part which controls start and stop of the apparatus, the rotating speed of each of the rotor in the centrifugal classification rotor 3 and supply amount of the powder material during steady operation, and a rotation control part which controls the rotating speed before and immediately after the fluid is jetted from each of the fluid jetting nozzles 5 so as to fluidize the powder material in the fluidized bed container 4 during the initial operation of the apparatus. The fluidized bed pulverizing apparatus of the present invention produces product powder by controlling the rotating speed of the centrifugal classification rotor 3 before and after the powder material in the fluidized bed container 4 are started to flow higher than the rotating speed of the rotor during the steady operation.

At the beginning of the operation of the fluidized bed pulverizing apparatus of the present invention, the powder material is charged in such amount that the height of the charged powder material within the fluidized bed container 4 comes up to near or by the height of the position where the fluid jetting nozzles 5 are provided, and firstly, the centrifugal classification rotor 3 is controlled so as to rotate at higher speed than that during the steady operation. Thereafter, the fluid is jetted from each of the fluid jetting nozzles 5 so as to fluidize the powder material in the fluidized bed container 4, and pulverization is started at the same time. The powder material whirled up to the upper part is classified in the centrifugal classification rotor 3, so as to produce product powder having a desired particle size. Thus, when the material powder is began to be introduced into the centrifugal classification rotor 3 along with fluid, the rotating speed of the centrifugal classification rotor 3 is higher than the predetermined rotating speed during the steady operation, thereby increasing ability of returning particles of powder having large size particles (coarse particles) back to the side of the fluidized bed container 4 compared to that during the steady operation.

When the powder material is pulverized by the fluidized bed pulverizing apparatus, immediately after the beginning of the operation of the apparatus, there is a low content of the particles of powder each having a small particle size (finely-pulverized particles) in the fluidized bed container 4, and most of the particles of the powder are non-pulverized large size particles (coarse particles). These particles are whirled up to the upper part of the fluidized bed container 4, the particles along with the fluid flows are introduced into a gap between the rotors of the centrifugal classification rotors 3. The classification by the centrifugal separation of the centrifugal classification rotor 3 is performed in such a manner that material powder is not precisely separated based on a predetermined particle size, but separated with stochastic spread according to the rotating speed of the rotor. Thus, part of the coarse particles passes through the centrifugal classification rotor 3 and is discharged from the outlet 2. In the conventional fluidized bed pulverizing apparatus, since from the beginning of the operation, the centrifugal classification rotor 3 is rotated at the same rotating speed as that during the steady operation, the coarse particle content in the powder material is high immediately after the beginning of the operation. Thus, the content of the coarse particle discharged from the outlet 2 tends to high. By contrast, the content of finely-pulverized particles in powder discharged from the outlet 2 tends to small. On the other hand, in the fluidized bed pulverizing apparatus of the present invention, during the initial operation of the apparatus, the rotating speed of the centrifugal classification rotor 3 is set higher than that during the steady operation of the apparatus. The rotating speed during the initial operation is adjusted to higher then the rotating speed during the steady operation, so that the particles of the powder having large size particles (coarse particles) are hard to pass through to the side of the outlet 2 and to mix in the product powder. Thus, the coarse particle content in the product powder immediately after the beginning of the operation of the apparatus can be adjusted to the same as that during the steady operation.

By controlling the rotating speed of the centrifugal classification rotor 3 before and after the beginning of the operation of the apparatus as described above, the quality of the product powder can be maintained from immediately after the beginning of the operation of the apparatus as high as the quality thereof during the steady operation. Thus, it is not necessary to discard the discharged powder as an off-specification product, or recycle the discharged powder as the powder material until the operation of the apparatus becomes steady state. Therefore, the production efficiency of the product powder is improved, particularly, in the case where various types of products are produced in small amounts for a short time, high quality product powder can be efficiently produced.

Note that in the case where the rotating speed of the centrifugal classification rotor 3 is kept high for a long period of time beyond necessity after the beginning of the operation of the apparatus, the particle sizes of the product powder become excessively small, which is not preferable in terms of quality control of the product powder. When a certain time has passed from the beginning of the initial operation of the apparatus, it is necessary to return the rotating speed of the centrifugal classification rotor 3 to the rotating speed of the steady operation. As a result, the method for producing powder of the present invention and the fluidized bed pulverizing apparatus of the present invention also enables to precisely produce product powder having stable quality (particle size) at the time of the steady operation immediately after the beginning of the operation of the apparatus.

When a pulverized toner having a size of micron order used for an electrophotographic image forming apparatus is produced, the rotating speed of the centrifugal classification rotor 3 during the initial operation of the apparatus is faster than that during the steady operation, preferably by 5 m/s to 50 m/s, particularly preferably by 10 m/s to 30 m/s in terms of the circumferential speed of the rotor of the centrifugal classification rotor 3. When the circumferential speed of rotor is less than 5 m/s, the classification of the coarse particles during the initial operation of the apparatus is less effective, and the quality of product powder during the initial operation of the apparatus may not be sufficient. When the circumferential speed of the rotor is faster than that during steady operation, i.e. 50 m/s, there is a high possibility that the particles of powder each having a small particle size are returned back to the fluidized bed container 4, and the particle size of the product powder during the initial operation of the apparatus becomes excessively small, or the production efficiency of the product powder may be poor. When the pulverized toner is produced, the circumferential speed of the rotor during the steady operation is controlled within a range from approximately 30 m/s to approximately 55 m/s in many cases. In this case, the circumferential speed of the rotor after the beginning of the operation of the apparatus is particularly preferably controlled within a range from 55 m/s to 65 m/s, in addition to the above conditions.

The duration for controlling the rotating speed of the centrifugal classification rotor 3 high by the rotation control part in the control device 7, that is the time between the beginning of the initial operation of the apparatus and the beginning of the steady operation, is approximately 30 seconds to approximately 180 seconds, preferably approximately 30 seconds to approximately 150 seconds. The duration for controlling the rotating speed of the centrifugal classification rotor 3 high from the beginning of the initial operation of the apparatus is preferably the time for the particle size of the powder material in the fluidized bed container 4 of the fluidized bed pulverizing apparatus to be in the steady state. When the pulverized toner is produced, it takes 30 seconds to approximately 180 seconds, until the particle size of the powder material in the fluidized bed container 4 becomes a steady state. In the light of the time required for decreasing the rotating speed of the centrifugal classification rotor 3 from the beginning of the operation of the apparatus to the rotating speed of the beginning of the steady operation, namely, usually approximately 10 seconds to approximately 20 seconds, the time for starting to decrease the rotating speed of the centrifugal classification rotor 3 is approximately 10 seconds to approximately 170 seconds from the beginning of the fluidization of the powder material, specifically, after fluid is jetted from each of the fluid jetting nozzles, and the powder material is started to fluidize. When the time for keeping the high rotating speed is shorter than 30 seconds, the coarse particle content in the product powder is increased, and it is not preferable in terms of quality control. When the time for keeping the high rotating speed is longer than 180 seconds, the production efficiency may decrease, and the powder stay in the fluidized bed container 4 for a long period of time, causing excessively pulverizing the powder. In the classification in the centrifugal classification rotor 3, the average particle size and particle size distribution of the product powder may vary.

The control device 7 preferably includes a pressure control device which controls the internal pressure of the fluidized bed container to negative pressure. The pressure control device preferably controls the internal pressure of the fluidized bed container 4 to negative pressure by controlling the suction force of an exhaust fan (not shown) provided in the outlet 2. The controlled pressure is different from the atmospheric pressure by 0 kPa to −5 kPa, preferably −1 kPa to −3 kPa. By controlling the internal pressure of the fluidized bed container 4 to negative pressure, the flow rate of the fluid jetted from each of the fluid jetting nozzles 5 is increased, thereby improving efficiency of pulverization cased by collision of powder material entrained in the fluid. By controlling the internal pressure of the fluidized bed container 4 to negative pressure, the classification efficiency of the centrifugal classification rotor is improved, possibly thereby obtaining sharp particle size distribution of the powder after classification. However, the internal pressure of the fluidized bed container 4 becomes lower than −5 kPa, the mass flow rate of the fluid decreases, and efficiency of entraining the powder material becomes poor. Thus, the controlled pressure is preferably approximately 0 kPa to approximately −5 kPa.

The control device 7 preferably includes a temperature control device which controls the temperature inside the fluidized bed container. The temperature control device preferably controls the temperature inside the pulverization chamber 4, which is a fluidized bed container, by providing a heater in the pulverization chamber 4, or by controlling the temperature of the fluid jetted from each of the fluid jetting nozzles 5 and supplying the fluid. The temperature inside the fluidized bed container 4 is 0° C. to 60° C., preferably 10° C. to 40° C. By controlling the temperature inside the fluidized bed container 4, the efficiency of entraining the powder material in the fluid jetted from each of the fluid jetting nozzles 5 is increased, thereby improving efficiency of pulverization cased by collision between the particles of powder material. However, the temperature inside the fluidized bed container 4 is higher than 70° C., the powder including a resin, such as toner, may be melted or fused. The temperature is particularly suitably controlled at approximately 0° C. to approximately 60° C.

The control device 7 preferably includes an injection pressure control part which controls the injection pressure of the fluid jetted from each of the fluid jetting nozzles. The injection pressure of the fluid jetted from each of the fluid jetting nozzles is a main factor of controlling the flow rate of the jetted fluid, and can control the flow rate of the fluid jetted from each of the fluid jetting nozzles. The flow rate of the jetted fluid influences the pulverization efficiency of the powder material in the fluidized bed container 4, and the flow rate of the fluid in the centrifugal classification rotor 3, namely, the classification efficiency of the centrifugal classification rotor 3, and further influences the production speed of the product powder, and quality such as particle size, and particle size distribution.

When a pulverized toner used for an electrophotographic image forming apparatus having a particle size of micron order is produced, the injection pressure of the fluid jetted from the fluid jetting nozzle is preferably controlled at 0.3 MPa to 0.8 MPa. When the injection pressure of the fluid jetted from each of the fluid jetting nozzles is less then 0.3 MPa, the speed of the jetted fluid is slow, failing to sufficiently pulverize the powder material. The injection pressure of the fluid jetted from the fluid jetting nozzle is more than 0.8 MPa, the amount of the jetted fluid is excessively large. Accordingly, the flow rate of the fluid passing through the centrifugal classification rotor 3 increases, the classification efficiency of the centrifugal classification rotor 3 decreases, and coarse particles each having a large particle size may be mixed in product powder.

The fluidized bed pulverizing apparatus of the present invention preferably includes a control part which controls from the beginning to the completion of the operation of the apparatus, such as supply of powder material into the fluidized bed container, the rotation of the centrifugal classification rotor by controlling the rotational frequency, and jetting of fluid from each of the fluid jetting nozzles, and discharging powder classified in the centrifugal classification rotor. By automatically controlling a series of operations described above, the fluidized bed pulverizing apparatus of the present invention and the method for producing powder can almost automatically form product powder having a desired particle size from the powder material. Moreover, in the case where a particle size measurement device for measuring the particle size or the particle size distribution of the powder is provided in an outlet passage of the product powder, by using the data of the particle size or particle size distribution obtained by the particle size measurement device, the rotating speed of the centrifugal classification rotor and the supply amount of the powder material to the fluidized bed container are preferably controlled. As the particle size measurement device, a continuous particle size measurement device using a laser light is preferable.

The powder used for the fluidized bed pulverizing apparatus and the method for producing powder of the present invention are not particularly limited, and may be appropriately selected depending on the intended purpose. Examples thereof include a toner, materials for cosmetics, materials for pharmaceutical products, materials for foods, and materials for chemicals. Of these, a toner is particularly preferable.

As the toner, a method for producing a toner, a volume average particle size of the toner, etc. are not particularly limited and may be appropriately selected depending on the intended purpose.

The volume average particle size of the toner as the powder is preferably 3 μm to 15 μm, more preferably 4 μm to 9 μm. When the volume average particle size is less than 3 μm, conveyance of the toner in an image forming apparatus may be adversely affected. When the volume average particle size is more than 15 μm, image quality of an image formed may be rough.

The volume average particle size of the toner may be measured using a MULTISIZER (manufactured by Beckman Coulter, Inc.).

The fluidized bed pulverizing apparatus and the method for producing powder of the present invention are preferably used when a pulverized toner having a particle size of micron order used for an electrophotographic image forming apparatus is produced. The recent toner has a strict limitation for contained large size particles therein in addition to an average particle size. The fluidized bed pulverizing apparatus of the present invention can produce a toner satisfying such demands of the recent toner. By using the thus produced pulverized toner in an electrophotographic image forming apparatus, resolution and background smear are improved and a printed matter having stable quality can be provided.

In the fluidized bed pulverizing apparatus and the method for producing powder of the present invention, as the fluid, at least one of air, nitrogen, carbon dioxide, helium, and argon or a mixture of two or more of the aforementioned gases. The above-mentioned gases and mixed gas, toner than air, are easily used, because there is no possibility of dust explosion or ignition even in the production of flammable powder such as toner, and these gases have no toxicity to human body or reactivity with the powder. Moreover, these gases are relatively inexpensive and easily obtainable. In the case where there is no possibility of dust explosion or ignition, use of air is economical.

EXAMPLE

Hereinafter, Examples of the present invention will be explained, which shall not be construed as limiting the present invention.

Example 1

Production of Toner Material 1 (Powder Material)

A mixture of 70% by mass of a polyester resin, 10% by mass of a styrene-acrylic copolymer, 15% by mass of carbon black, and 5% by mass of wax (a mixture of carnauba wax and rice wax) was melt-kneaded using an extruder, and then cooled to be solidified. The solidified mixture was coarsely pulverized with a hammer mill to prepare Toner Material 1 (powder material). The Toner Material 1 had a mass average particle size of 20 μm.

Production of Powder Using Fluidized Bed Pulverizing Apparatus

The fluidized bed container 4 of the fluidized bed pulverizing apparatus shown in FIG. 2 was charged with 30 kg of the produced Toner Material 1, the rotating speed of the motor 6 was adjusted by the control device 7 so that the centrifugal classification rotor 3 was rotated at a circumferential speed of 60 m/s. From two fluid jetting nozzles 5, compressed air of room temperature (approximately 20° C.) was jetted respectively with an injection pressure of 0.6 MPa. After 15 seconds the compressed air was jetted from each of the fluid jetting nozzles 5, the rotating speed of the motor 6 was started to decrease by the control device 7, and then the rotating speed of the motor 6 was controlled so that the centrifugal classification rotor 3 was rotated at a circumferential speed of 45 m/s, and the fluidized bed pulverizing apparatus was continuously operated. The fluidized bed container was supplied with the Toner Material 1 at 0.75 kg/min as an indication, corresponding to an average discharge amount of a product toner (product powder).

After the fluidized bed pulverizing apparatus was operated for 1 hour, 45 kg of the product toner was obtained. The particle size of the toner was measured using a MULTISIZER manufactured by Beckman Coulter, inc. The particle size distribution of the product toner was as follows: a mass average particle size was 6.5 μm, a fine particle (particle diameter: 4 μm or less) content was 45 number average % and a coarse particle (particle diameter: 16 μm or greater) content was 0.5% by volume based on the mass average.

Example 2

The same fluidized bed pulverizing apparatus and powder material (Toner Material 1) as those of Example 1 were used, and the fluidized bed container 4 of the fluidized bed pulverizing apparatus was charged with 30 kg of the powder material, and then the rotating speed of the motor 6 was adjusted by the control device 7 so that the centrifugal classification rotor 3 was rotated at a circumferential speed of 60 m/s. From two fluid jetting nozzles 5, compressed air of room temperature (approximately 20° C.) was jetted respectively with an injection pressure of 0.6 MPa. After 120 seconds the compressed air was jetted from each of the fluid jetting nozzles 5, the rotating speed of the motor 6 was started to decrease by the control device 7, and then the rotating speed of the motor 6 was controlled so that the centrifugal classification rotor 3 was rotated at a circumferential speed of 45 m/s, and the fluidized bed pulverizing apparatus was continuously operated. The fluidized bed container was supplied with the Toner Material 1 at 0.75 kg/min as an indication, corresponding to an average discharge amount of a product toner (product powder).

After the fluidized bed pulverizing apparatus was operated for 1 hour, 45 kg of the product toner was obtained. The particle size of the toner was measured by the MULTISIZER manufactured by Beckman Coulter, Inc. The particle size distribution of the product toner was as follows: a mass average particle size was 6.5 μm, a fine particle (particle diameter: 4 μm or less) content was 43 number average % and a coarse particle (particle diameter: 16 μm or greater) content was 0.5% by volume based on the mass average.

Example 3

The same fluidized bed pulverizing apparatus and powder material (Toner Material 1) as those of Example 1 were used, and the fluidized bed container 4 of the fluidized bed pulverizing apparatus was charged with 30 kg of the powder material, and then the rotating speed of the motor 6 was adjusted by the control device 7 so that the centrifugal classification rotor 3 was rotated at a circumferential speed of 60 m/s. A suction fan was provided at the side of an outlet 2 so as to suction air in the fluidized bed container 4 from the side of the outlet 2. While the pressure in the fluidized bed container 4 was controlled at −3 kPa by adjusting the suction force of the suction fan using the control device 7, from two fluid jetting nozzles 5, compressed air at approximately 30° C. was jetted respectively with an injection pressure of 0.6 MPa. After 120 seconds the compressed air was jetted from each of the fluid jetting nozzles 5, the rotating speed of the motor 6 was started to decrease by the control device 7, and then the rotating speed of the motor 6 was controlled so that the centrifugal classification rotor 3 was rotated at a circumferential speed of 45 m/s, and the fluidized bed pulverizing apparatus was continuously operated. The fluidized bed container was supplied with the Toner Material 1 at 0.80 kg/min as an indication, corresponding to an average discharge amount of a product toner (product powder).

After the fluidized bed pulverizing apparatus was operated for 1 hour, 48 kg of the product toner was obtained. The particle size of the toner was measured by the MULTISIZER manufactured by Beckman Coulter, Inc. The particle size distribution of the product toner was as follows: a mass average particle size was 6.5 μm, a fine particle (particle diameter: 4 μm or less) content was 43 number average % and a coarse particle (particle diameter: 16 μm or greater) content was 0.5% by volume based on the mass average.

Comparative Example 1

The same fluidized bed pulverizing apparatus and powder material (Toner Material 1) as those of Example 1 were used, and the fluidized bed container 4 of the fluidized bed pulverizing apparatus was charged with 30 kg of the powder material, and then the rotating speed of the motor 6 was adjusted by the control device 7 so that the centrifugal classification rotor 3 was rotated at a circumferential speed of 45 m/s. In the side of the outlet 2, a suction fan was provided so as to suction air in the fluidized bed container 4 from the side of the outlet 2. While the pressure in the fluidized bed container 4 was controlled at −3 kPa by adjusting the suction force of the suction fan using the control device 7, from two fluid jetting nozzles 5, compressed air of room temperature (approximately 20° C.) was jetted respectively with an injection pressure of 0.6 MPa. The fluidized bed pulverizing apparatus was continuously operated while the circumferential speed of the centrifugal classification rotor 3 was kept at 45 m/s. The fluidized bed container was supplied with the Toner Material 1 at 0.75 kg/min as an indication, in the same manner as in Example 1.

Although it was attempted to operate the fluidized bed pulverizing apparatus for 1 hour, the current value of the drive motor 6 of the centrifugal classification rotor 3 was not stable, and after about 15 minutes the operation was started the apparatus had to be stopped. The amount of the obtained product toner was about 10 kg (equal to 40 kg/hr). The particle size of the toner was measured by the MULTISIZER manufactured by Beckman Coulter, Inc. The particle size distribution of the product toner was as follows: a mass average particle size was 6.9 μm, a fine particle (particle diameter: 4 μm or less) content was 43 number average % and a coarse particle (particle diameter: 16 μm or greater) content was 2.5% by volume based on the mass average.

Comparative Example 2

The same fluidized bed pulverizing apparatus and powder material (Toner Material 1) as those of Example 1 were used, and the fluidized bed container 4 of the fluidized bed pulverizing apparatus was charged with 20 kg of the powder material, and then the rotating speed of the motor 6 was adjusted by the control device 7 so that the centrifugal classification rotor 3 was rotated at a circumferential speed of 45 m/s. A suction fan was provided at the side of an outlet 2 so as to suction air in the fluidized bed container 4 from the side of the outlet 2. While the pressure in the fluidized bed container 4 was controlled at −3 kPa by adjusting the suction force of the suction fan using the control device 7, from two fluid jetting nozzles 5, compressed air of room temperature (approximately 20° C.) was jetted respectively with an injection pressure of 0.6 MPa. The fluidized bed pulverizing apparatus was continuously operated while the circumferential speed of the centrifugal classification rotor 3 was kept at 45 m/s. The fluidized bed container was supplied with the Toner Material 1 at about 0.47 kg/min as an indication, which could stabilize the current value of the drive motor 6 of the centrifugal classification rotor 3.

In the fluidized bed pulverizing apparatus was operated for 1 hour, and the amount of the obtained product toner was about 28 kg. The particle size of the toner was measured by the MULTISIZER manufactured by Beckman Coulter, Inc. The particle size distribution of the product toner was as follows: a mass average particle size was 6.7 μm, a fine particle (particle diameter: 4 μm or less) content was 43 number average % and a coarse particle (particle diameter: 16 μm or greater) content was 2.5% by volume based on the mass average.

<Consideration of Example and Comparative Example>

In Examples 1 to 3 of the present invention, during the initial operation of the fluidized bed pulverizing apparatus, before the powder material was fluidized and pulverized by jetting air from the fluid jetting nozzles 5, the centrifugal classification rotor 3 was rotated at rotating speed (circumferential speed: 60 m/s) faster than the rotating speed during the steady operation (in the case of Examples 1 to 3, circumferential speed: 45 m/s). Thus, the particles of the powder each having a large particle size could be efficiently returned back to the fluidized bed container 4 by means of the high speed rotating centrifugal classification rotor 3, even though usually particles of the powder each having a large particle size (large size particles) were entrained in air flow and easily discharged from the centrifugal classification rotor 3 due to unstable flow state during the initial operation of the apparatus. As a result, the large size particle content in the product powder could be maintained low.

As in Examples 2 and 3, the rotating speed of the centrifugal classification rotor 3 was kept faster than a certain rotating speed preferably until the fluid state and the pulverized particle content in the fluidized bed container were sufficiently stabilized. Moreover, from Example 3, it was understood that the pulverization efficiency of the powder material (production efficiency of powder) was improved by making the pressure of the fluidized bed container 4 to negative pressure, or by making the temperature high. Moreover, although data is not described herein, the particle size distribution of the product powder which has been pulverized tends to be sharp by making the pressure of the fluidized bed container 4 to negative pressure.

On the other hand, as in Comparative Examples 1 and 2, in the case where, during the initial operation of the fluidized bed pulverizing apparatus, the centrifugal classification rotor 3 was rotated at the same rotating speed as that during the steady operation (circumferential speed: 45 m/s), due to the influence of the large size particles during the initial operation caused the following problems: the drive of the centrifugal classification rotor 3 became unstable (Comparative Example 1); and the apparatus had to be operated by considerably reducing the supply amount of the material (Comparative Example 2). Furthermore, in Comparative Examples, the large size particle content in the product powder increased, and average particle size became larger than that intended.

What is claimed is:

1. A method for producing powder comprising:

supplying a powder material from a powder material supply inlet to a fluidized bed container;

jetting fluid from each of a plurality of fluid jetting nozzles provided in the fluidized bed container so as to collide against each other, thereby fluidizing and pulverizing the powder material in the fluidized bed container to form powder;

classifying the powder using a centrifugal classification rotor provided at the upper part of the fluidized bed container; and discharging the classified powder from an outlet by being guided by the centrifugal classification rotor;

wherein the centrifugal classification rotor is rotated at a first rotating speed for a predetermined time from the beginning of the flow of the powder material in the fluidized bed container, and at a second rotating speed after the predetermined time has passed, and the centrifugal classification rotor is controlled so that the first rotating speed is higher than the second rotating speed.

2. The method for producing powder according to claim 1, wherein the jetting further comprises controlling the internal pressure of the fluidized bed container to negative pressure.

3. The method for producing powder according to claim 1, wherein the jetting further comprises controlling the temperature inside the fluidized bed container.

4. The method for producing powder according to claim 1, wherein the jetting further comprises controlling the injection pressure of the fluid jetted from the fluid jetting nozzle.

5. The method for producing powder according to claim 1, wherein the predetermined time from the beginning of the flow of the powder material for rotating the centrifugal classification rotor at the first rotating speed is controlled.

6. The method for producing powder according to claim 5, wherein the predetermined time is 10 seconds to 170 seconds.

7. The method for producing powder according to claim 1, wherein the supplying, the jetting, the classifying, and the discharging are performed by automatic control.

8. The method for producing powder according to claim 1, wherein the powder is a toner.

9. The method for producing powder according to claim 1, wherein the fluid is one selected from the group consisting of air, nitrogen, carbon dioxide, helium and argon or a mixture of two or more of these gases.

10. The method for producing powder according to claim 1, wherein the first rotating speed of the centrifugal classification rotor is faster than the second rotating speed by 10 m/s to 30 m/s in terms of a circumferential speed of a rotor of the centrifugal classification rotor.

* * * * *